US012599255B1

(12) United States Patent
Chen

(10) Patent No.: US 12,599,255 B1
(45) **Date of Patent: *Apr. 14, 2026**

(54) PILLOWCASE

(71) Applicant: JingWeiLianHe (Hong Kong) Technology Co., Limited, Hong Kong (HK)

(72) Inventor: Xin Chen, Hong Kong (HK)

(73) Assignee: JingWeiLianHe (Hong Kong) Technology Co., Limited, Hong Kong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 19/212,492

(22) Filed: May 19, 2025

(51) Int. Cl.
*A47G 9/02* (2006.01)
*A47G 9/00* (2006.01)

(52) U.S. Cl.
CPC ..... *A47G 9/0253* (2013.01); *A47G 9/007* (2013.01)

(58) Field of Classification Search
None
See application file for complete search history.

(56) References Cited

U.S. PATENT DOCUMENTS 2,085,296 A * 6/1937 Carey ..... A61G 7/05723 128/889
12,144,451 B1 * 11/2024 Chen ..... D06M 15/59

FOREIGN PATENT DOCUMENTS

CN 108938436 * 12/2018
EP 3760238 B1 * 11/2024 ..... A41B 17/00
RU 2779331 C2 * 9/2022 ..... A47G 9/02

OTHER PUBLICATIONS https://patents.google.com/patent/RU2779331C2/en?oq=RU2779331 (Year: 2018).*
https://patents.google.com/patent/EP3760238A1/en?oq=EP3760238 (Year: 2020).*
https://patents.google.com/patent/CN108938436A/en?oq=CN108938436 (Year: 2018).*

* cited by examiner

*Primary Examiner* — Arti Singh-Pandey

(57) ABSTRACT

A pillowcase includes a pillowcase main body. The pillowcase main body is made of a fabric. The pillowcase main body includes an upper covering surface and a lower covering surface. The upper covering surface is connected to the lower covering surface to form a first accommodating space configured to accommodate a pillow core. The fabric includes a carrier and a care agent. The care agent is mixed with the carrier. The care agent is mixed with the carrier through an immersion method; a liquid pick-up rate is controlled between 60% and 80%; and shaping and drying are carried out to mix the care agent with the carrier. A material of the carrier includes spandex and a polyamide fiber. The carrier of the fabric is composed of the polyamide fiber and the spandex. Due to the addition of the care agent, this pillowcase can have a skincare effect.

17 Claims, 9 Drawing Sheets

PILLOWCASE

TECHNICAL FIELD

The present disclosure relates to the field of pillowcases, and in particular, to a pillowcase.

BACKGROUND

It is usually very busy in modern life, and many people may not have enough time in the day to do tedious skincare. However, even in such a busy situation, people have fixed sleep time every night. Meanwhile, in a deep sleep stage, cells in the human body will be repaired and regenerated fastest. When skincare is combined with sleep, it is possible to better use this period of time for skin repair, thereby making the skincare effect more significant. Therefore, there is an urgent need on the market to provide a pillow or pillowcase that combines skincare with sleep.

SUMMARY

In order to overcome the shortcomings of the prior art, the present disclosure provides a pillowcase, including:

a pillowcase main body, wherein the pillowcase main body is made of a fabric; the pillowcase main body includes an upper covering surface and a lower covering surface; the upper covering surface is connected to the lower covering surface to form a first accommodating space around the upper covering surface and the lower covering surface; the first accommodating space is configured to accommodate a pillow core; the fabric includes a carrier and a care agent; the care agent is mixed with the carrier through an immersion method; a liquid pick-up rate is controlled between 60% and 80%; and shaping and drying are carried out to mix the care agent with the carrier.

As the improvement of the present disclosure, the carrier is formed by interweaving the polyamide fiber with the spandex, so that the fabric has good elasticity, breathability, wear resistance, and creasing resistance.

As the improvement of the present disclosure, a material of the carrier includes spandex and a polyamide fiber, the polyamide fiber in the carrier accounts for 60% to 95%, and the spandex accounts for 5% to 40%.

As the improvement of the present disclosure, the care agent is added to the carrier according to a ratio of 20 g/L to 50 g/L.

As the improvement of the present disclosure, the pillowcase includes a front side, a back side, a left side, a right side, an upper side, and a lower side, The left side is opposite to the right side, the front side is opposite to the back side, and the upper side is opposite to the lower side.

As the improvement of the present disclosure, a distance from the left side to the right side is a first distance, and the first distance is 30 cm to 145 cm.

As the improvement of the present disclosure, the first distance is 40 cm to 60 cm.

As the improvement of the present disclosure, a distance from the front side to the back side is a second distance, and the second distance is 15 cm to 60 cm.

As the improvement of the present disclosure, the second distance is 20 cm to 40 cm.

As the improvement of the present disclosure, a distance from the upper side to the lower side is a third distance; and the third distance is 0 to 16 cm.

As the improvement of the present disclosure, the third distance is 10 cm to 15 cm.

As the improvement of the present disclosure, the pillowcase main body at least includes one accommodating opening; and a pillow core is placed in the first accommodating space through the accommodating opening.

As the improvement of the present disclosure, the care agent at least includes sodium hyaluronate.

As the improvement of the present disclosure, the care agent further includes at least one of a moisturizer, an antioxidant, and a spice.

As the improvement of the present disclosure, the pillowcase includes: an upper covering surface, a lower covering surface, an outer cover portion connected between the upper covering surface and the lower covering surface and enclosing the periphery of a pillow core, and a connecting member connected between the upper covering surface and the lower covering surface and passing through a first through hole in the pillow core.

As the improvement of the present disclosure, the connecting member includes a first connecting member disposed on the upper covering surface and a second connecting member disposed on the lower covering surface; when the pillowcase is sleeved on the pillow core, the first connecting member is detachably connected to the second connecting member through the first through hole.

As the improvement of the present disclosure, one of the upper covering surface and the lower covering surface is detachably connected to the outer cover portion, and the other of the upper covering surface and the lower covering surface is fixedly connected to the outer cover portion.

As the improvement of the present disclosure, a lower edge of the outer cover portion is detachably connected to a lower edge of the lower covering surface, forming a first angle; and an upper edge of the outer cover portion is fixedly connected to an upper edge of the upper covering surface, forming a second angle.

The present disclosure has the following beneficial effects. The present disclosure provides a pillowcase. The pillowcase includes a pillowcase main body, wherein the pillowcase main body is made of a fabric. The pillowcase main body includes an upper covering surface and a lower covering surface. The upper covering surface is connected to the lower covering surface to form a first accommodating space around the upper covering surface and the lower covering surface. The first accommodating space is configured to accommodate a pillow core. The fabric includes a carrier and a care agent. The care agent is mixed with the carrier through an immersion method; a liquid pick-up rate is controlled between 60% and 80%; and shaping and drying are carried out to mix the care agent with the carrier. A material of the carrier includes spandex and a polyamide fiber. The carrier of the fabric is composed of the polyamide fiber and the spandex. This combination can provide good wear resistance, elasticity, and comfort, so that the pillowcase is more durable and suitable for long-term use. Meanwhile, due to the addition of the care agent, this pillowcase can have a skincare effect.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
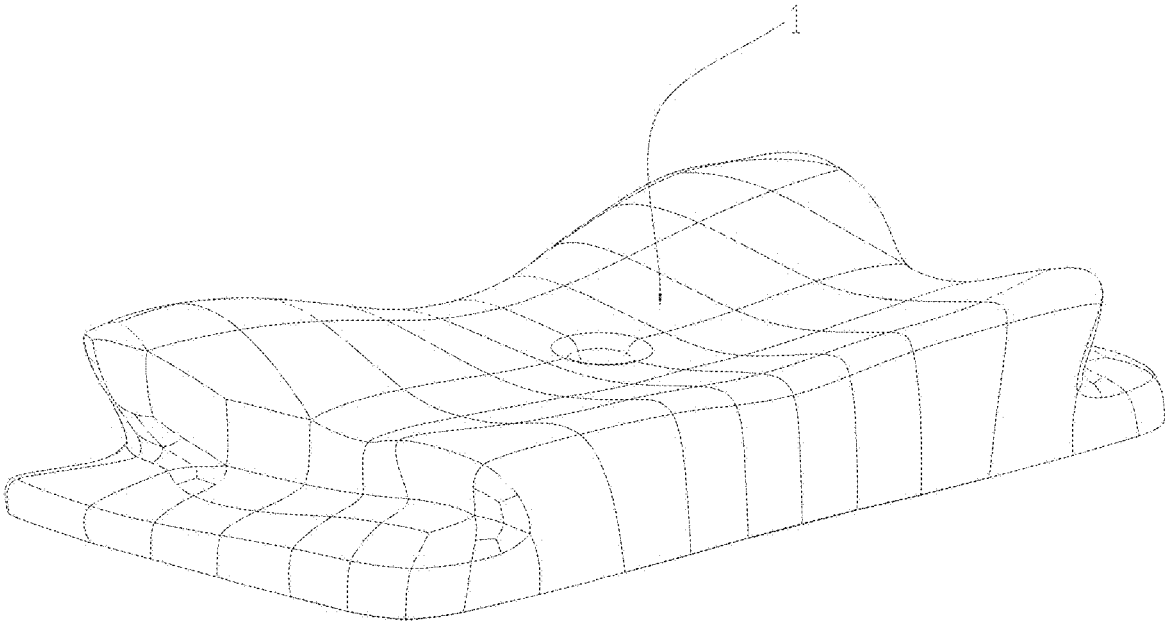
FIG. 1 is a schematic diagram of an entire structure of a pillowcase according to Embodiment 1 of the present disclosure.
Figure 2:
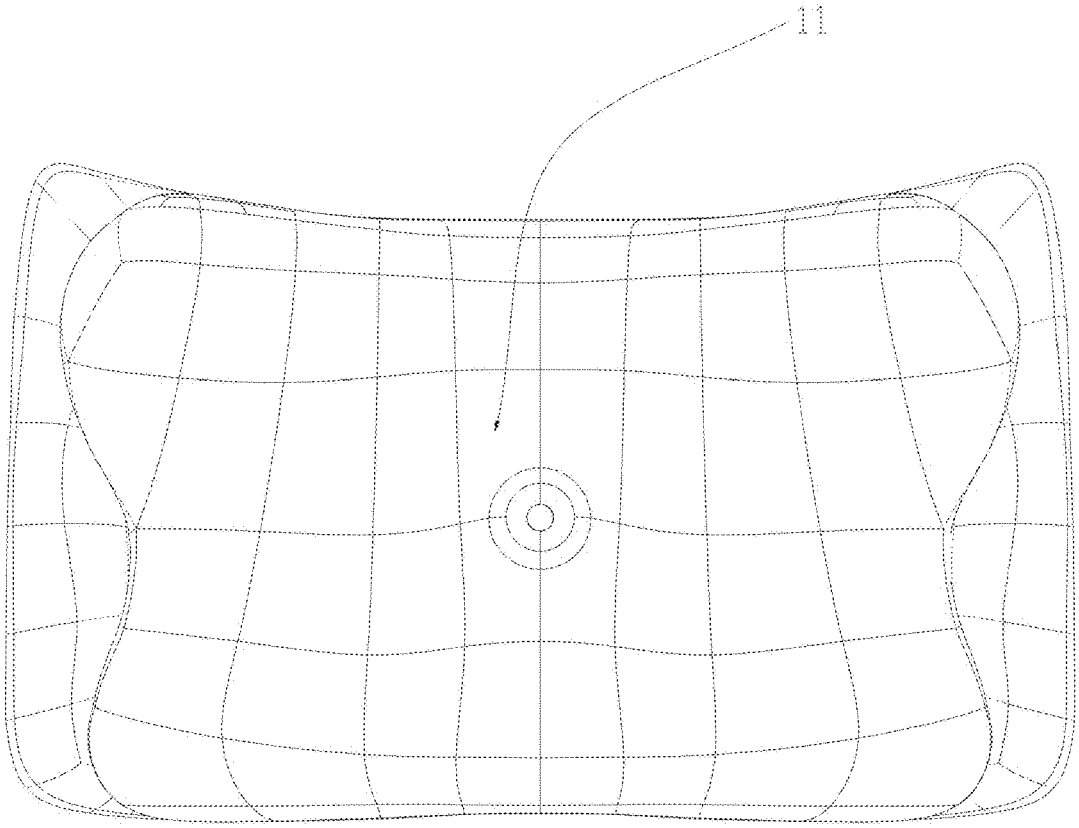
FIG. 2 is a top view of a pillowcase according to Embodiment 1 of the present disclosure.
Figure 3:
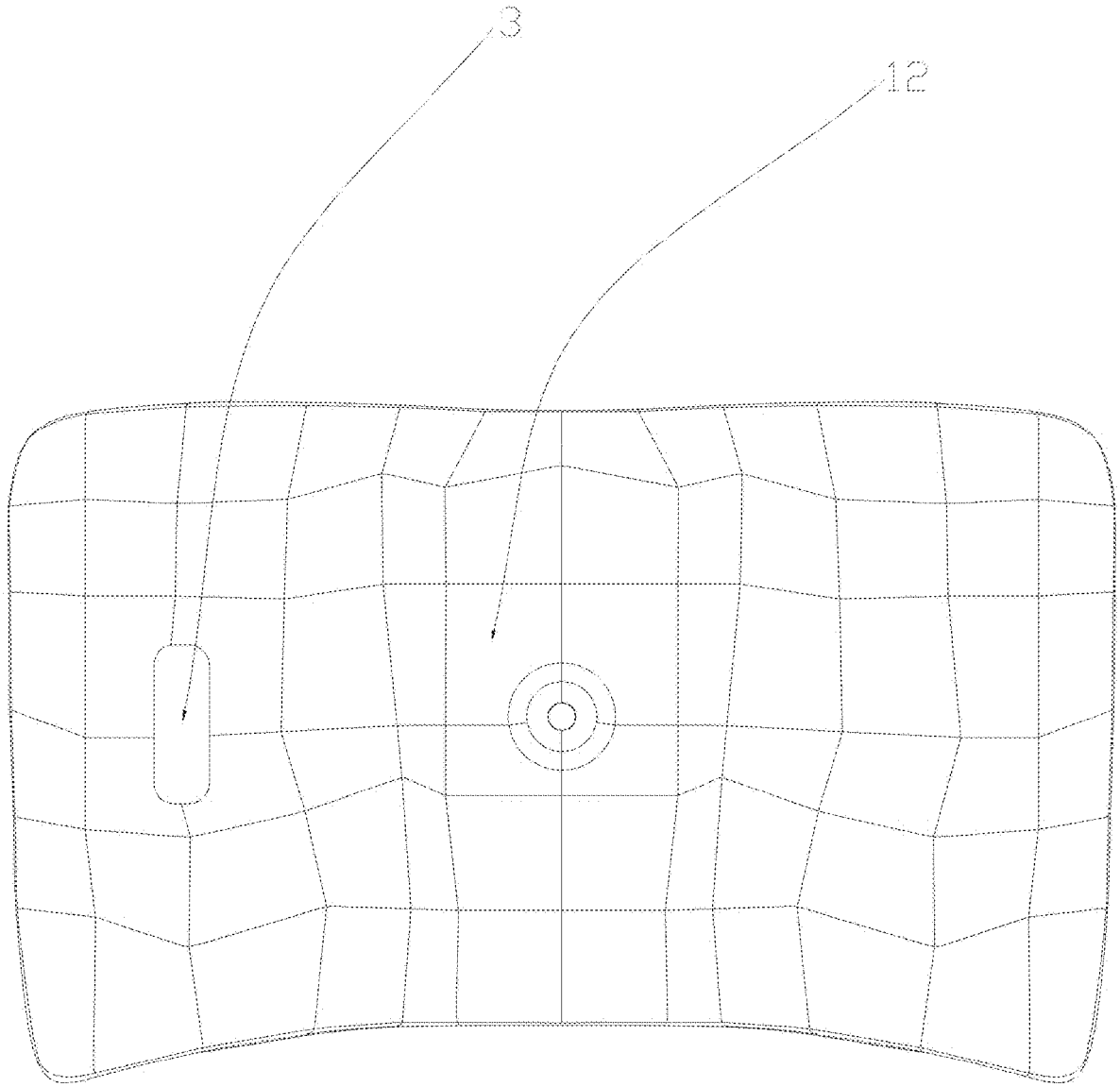
FIG. 3 is a bottom view of a pillowcase according to Embodiment 1 of the present disclosure.
Figure 4:
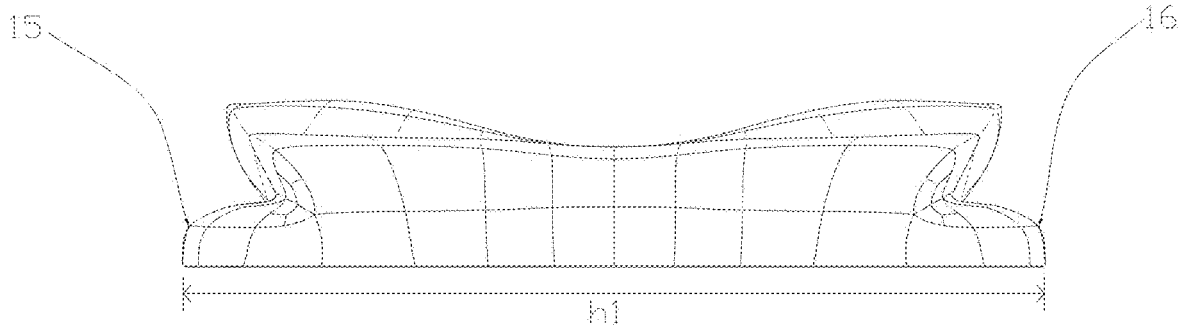
FIG. 4 is a front view of a pillowcase according to Embodiment 1 of the present disclosure.

Applicant filed a U.S. Pat. No. 12,144,451B issued on Nov. 19, 2024, which is incorporated herein by reference in its entirety.

Embodiment 1

Referring to FIG. 1 to FIG. 6, a pillowcase includes:

a pillowcase main body 1, wherein the pillowcase main body 1 is made of a fabric; the pillowcase main body 1 includes an upper covering surface 11 and a lower covering surface 12; the upper covering surface 11 is connected to the lower covering surface 12 to form a first accommodating space 2 around the upper covering surface 11 and the lower covering surface 12; the first accommodating space 2 is configured to accommodate a pillow core; the fabric includes a carrier and a care agent; the care agent is mixed with the carrier; and the carrier is composed of spandex and a polyamide fiber. The carrier of the fabric is composed of the polyamide fiber and the spandex. This combination can provide good wear resistance, elasticity, and comfort, so that the pillowcase is more durable and suitable for long-term use. Meanwhile, due to the addition of the care agent, this pillowcase can have a skincare effect.

In this embodiment, the carrier is formed by interweaving the polyamide fiber with the spandex, so that the fabric has good elasticity, breathability, wear resistance, and creasing resistance.

In this embodiment, the polyamide fiber in the carrier accounts for 60% to 95%, and the spandex accounts for 5% to 40%. The polyamide fiber is a high-strength synthetic fiber. The polyamide fiber in a high ratio can improve the overall strength and wear resistance of the fabric. The spandex has good elasticity, and an appropriate amount of spandex can make the fabric more elastic and improve the comfort of the pillowcase. A small amount of spandex can improve the moisture absorption of the fabric, which helps to keep a surface of the pillowcase dry and comfortable. The polyamide fiber in the high ratio has good creasing resistance, and the spandex in the low ratio makes the fabric easier to care for. This pillowcase is easier to clean and is dried faster, which reduces the cleaning burden on a user.

In this embodiment, the care agent is mixed with the carrier through an immersion method; a liquid pick-up rate is controlled between 60% and 80%; shaping and drying are carried out to mix the care agent with the carrier; and the care agent is added to the carrier according to a ratio of 20 g/L to 50 g/L. Controlling the pick-up rate between 60% and 80% can help adjust the content of the care agent. This can balance the care effect with the comfort of the fabric, avoiding the sticky feel caused by an excessive amount of the care agent. In addition, the shaping and drying process helps to combine the immersed care agent with the carrier, so as to ensure that the care agent and the carrier are fixed in the fabric. This helps to improve the durability of the care agent, keeping the care agent effective within a long time period.

In this embodiment, the pillowcase includes: a front side 13, a rear side 14, a left side 15, a right side 16, an upper side 17, and a lower side 18.

The left side 15 and the right side 16 are arranged opposite to each other, with a first distance h1 between the left side 15 and the right side 16 ranging from 30 cm to 145 cm. Advantageously, the first distance h1 may be 40 cm to 60 cm.

The front side 13 and the rear side 14 are arranged opposite to each other, with a second distance h2 between the front side 13 and the rear side 14 ranging from 15 cm to 60 cm. Advantageously, the second distance h2 is 20 cm to 40 cm. Specifically, the second distance h2 is 40 cm.

The upper side 17 and the lower side 18 are arranged opposite to each other, with a third distance h3 between the upper side 17 and the lower side 18 ranging from 0 cm to 16 cm. Advantageously, the third distance h3 is 10 cm to 15 cm. Specifically, the third distance h3 is 12 cm.

In this embodiment, the pillowcase main body 1 at least includes one accommodating opening 3; and the pillow core is placed in the first accommodating space 2 through the accommodating opening 3. Through the accommodating opening, the user can more easily adjust the position of the pillow core to meet a personal comfort need for better support and comfort.

In this embodiment, the care agent at least includes sodium hyaluronate. Hyaluronic acid can absorb and retain moisture. Adding the sodium hyaluronate to the pillowcase can provide an additional moisturizing effect and helps to prevent the skin from becoming rough due to friction and dryness during sleep. In addition, the hyaluronic acid helps maintain the skin elasticity, so that the skin appears fuller and more radiant, achieving a skincare effect.

In this embodiment, the care agent further includes at least one of a moisturizer, an antioxidant, and a spice. The moisturizer helps absorb and lock moisture, improve the softness of the pillowcase, and improve the comfort during sleep. Secondly, the antioxidant helps slow down the aging of the surface of the pillowcase, keeps the appearance clean, and improves the durability. In addition, the spice can provide the user with a more pleasant sleep environment, help relax the body and mind, and help improve the sleep quality. In addition, vitamins or amino acids can also be added into the care agent. Adding the amino acids can help reduce dryness, fragility, and branching of the hairs. This improves the softness and glossiness of the hairs. Adding the vitamins can provide additional care for the skin.

A pillow includes:

a pillow core 4; and a pillowcase main body 1, wherein the pillowcase main body 1 is made of a fabric; the pillowcase main body 1 includes an upper covering surface 11 and a lower covering surface 12; the upper covering surface 11 is connected to the lower covering surface 12 to form a first accommodating space 2 configured to accommodate the pillow core 4; the fabric includes a carrier and a care agent; the care agent is mixed with the carrier; and the carrier is composed of spandex and a polyamide fiber. The carrier of the fabric is composed of the polyamide fiber and the spandex. This combination can provide good wear resistance, elasticity, and comfort, so that the pillowcase is more durable and suitable for long-term use. Meanwhile, due to the addition of the care agent, this pillowcase can have a skincare effect.

In this embodiment, the carrier is formed by interweaving the polyamide fiber with the spandex, so that the fabric has good elasticity, breathability, wear resistance, and creasing resistance.

In this embodiment, the polyamide fiber in the carrier accounts for 60% to 95%, and the spandex accounts for 5% to 40%. The polyamide fiber is a high-strength synthetic fiber. The polyamide fiber in a high ratio can improve the overall strength and wear resistance of the fabric. The spandex has good elasticity, and an appropriate amount of spandex can make the fabric more elastic and improve the comfort of the pillowcase. A small amount of spandex can improve the moisture absorption of the fabric, which helps to keep a surface of the pillowcase dry and comfortable. The polyamide fiber in the high ratio has good creasing resistance, and the spandex in the low ratio makes the fabric easier to care for. This pillowcase is easier to clean and is dried faster, which reduces the cleaning burden on a user.

In this embodiment, the care agent is mixed with the carrier through an immersion method; a liquid pick-up rate is controlled between 60% and 80%; shaping and drying are carried out to mix the care agent with the carrier; and the care agent is added to the carrier according to a ratio of 20 g/L to 50 g/L. Controlling the pick-up rate between 60% and 80% can help adjust the content of the care agent. This can balance the care effect with the comfort of the fabric, avoiding the sticky feel caused by an excessive amount of the care agent. In addition, the shaping and drying process helps to combine the immersed care agent with the carrier, so as to ensure that the care agent and the carrier are fixed in the fabric. This helps to improve the durability of the care agent, keeping the care agent effective within a long time period.

In this embodiment, the pillowcase main body 1 includes a front side 13, a rear side 14, a left side 15, a right side 16, an upper side 17, and a lower side 18. The left side 15 and right side 16 are opposite to each other, with a first distance h1 between the first side 15 and the right side 16 ranging from 30 cm to 145 cm. Advantageously, the first distance h1 may be 40 cm to 60 cm. The front side 13 and the rear side 14 are opposite to each other, with a second distance h2 between the front side 13 and the rear side 14 ranging from 15 cm to 60 cm. Advantageously, the second distance h2 is 20 cm to 40 cm. The upper side 17 and the lower side 18 are opposite to each other, with a third distance h3 between the upper side 17 and the lower side 18 ranging from 0 cm to 16 cm. Advantageously, the third distance h3 is 10 cm to 15 cm.

In this embodiment, the pillowcase main body 1 at least includes one accommodating opening 3; and the pillow core 4 is placed in the first accommodating space 2 through the accommodating opening 3. Through the accommodating opening, the user can more easily adjust the position of the pillow core 4 to meet a personal comfort need for better support and comfort.

In this embodiment, the care agent at least includes sodium hyaluronate. Hyaluronic acid can absorb and retain moisture. Adding the sodium hyaluronate to the pillowcase can provide an additional moisturizing effect and helps to prevent the skin from becoming rough due to friction and dryness during sleep. In addition, the hyaluronic acid helps maintain the skin elasticity, so that the skin appears fuller and more radiant, achieving a skincare effect.

In this embodiment, the care agent further includes at least one of a moisturizer, an antioxidant, and a spice. The moisturizer helps absorb and lock moisture, improve the softness of the pillowcase, and improve the comfort during sleep. Secondly, the antioxidant helps slow down the aging of the surface of the pillowcase, keeps the appearance clean, and improves the durability. In addition, the spice can provide the user with a more pleasant sleep environment, help relax the body and mind, and help improve the sleep quality. In addition, vitamins or amino acids can also be added into the care agent. Adding the amino acids can help reduce dryness, fragility, and branching of the hairs. This improves the softness and glossiness of the hairs. Adding the vitamins can provide additional care for the skin.

In this embodiment, a material of the pillow core 4 includes at least one of down feather, memory foam, latex, or fibers. The pillow core made of the down feather has a light weight and excellent insulation performance, which can provide a warm feeling in the cold season. Meanwhile, the pillow core made of the down feather usually has good breathability, which helps maintain good air circulation. The pillow core made of the memory foam can provide a personalized support according to the shapes of the head and neck, which helps relieve the cervical pressure. The pillow core made of the latex have certain antibacterial property, which helps prevent bacterial growth and reduce odors. The pillow core made of the fiber material is suitable for people who are allergic to some feathers, and the pillow core made of the fiber material is usually easy to clean and convenient to maintain. The pillow cores made of different materials can meet the personalized needs of different people.

In this embodiment, the pillow core 4 has a first through channel 40. The first through channel 40 penetrates from an upper side to a lower side of the pillow core 4. The upper covering surface 11 of the pillowcase main body 1 includes a first connecting 111, and the lower covering surface 12 of the pillowcase main body 1 includes a second connecting 121. The first connecting 111 and the second connecting 121 are detachably connected into the first through channel 40. The first connecting 111 and the second connecting 121 are detachably connected into the first through channel 40 to fix the pillow core 4 in the pillowcase main body 1. Through this connection method, the pillow core 4 can be kept at a certain position relative to the pillowcase, which avoids the sliding of the pillow core 4 from affecting the user experience. Meanwhile, the first through channel 40 can promote the air circulation, which helps regulate the temperature and humidity inside the pillow to provide a more comfortable sleep environment. In addition, this connection method makes the appearance of the pillow more integral and smoother, avoids some exposed connecting structures or seams, improves the overall aesthetics, and gives people a simple and exquisite feeling. Due to the fact that the first connecting 111 and the second connecting 121 are in the first through channel 40, it is possible to prevent the user from being in direct contact with the first connecting 111 or the second connecting 121, thereby avoiding a possible discomfort.

Figure 5:
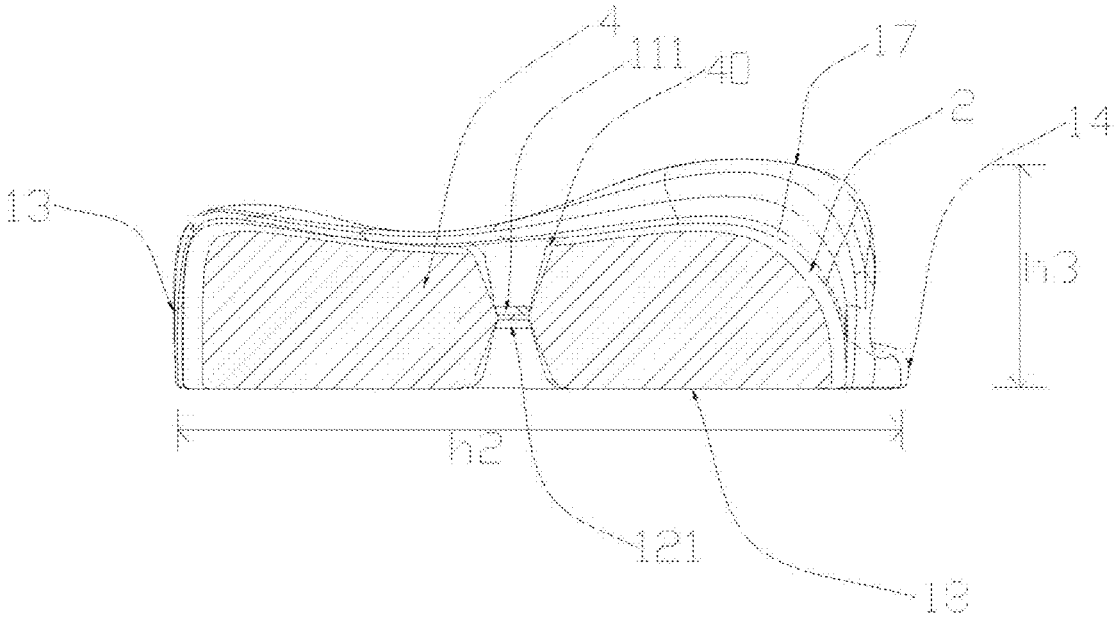
FIG. 5 is cross-sectional view of a side surface of a pillow according to Embodiment 1 of the present disclosure.

As shown in FIG. 5, in this embodiment, the first connecting 111 and the second connecting 121 are buttons. In other embodiments, the first connecting 111 and the second connecting 121 can also be connected in different ways, such as magnetic buckles, zippers, and hooks, to meet the needs of different users.

Figure 6:
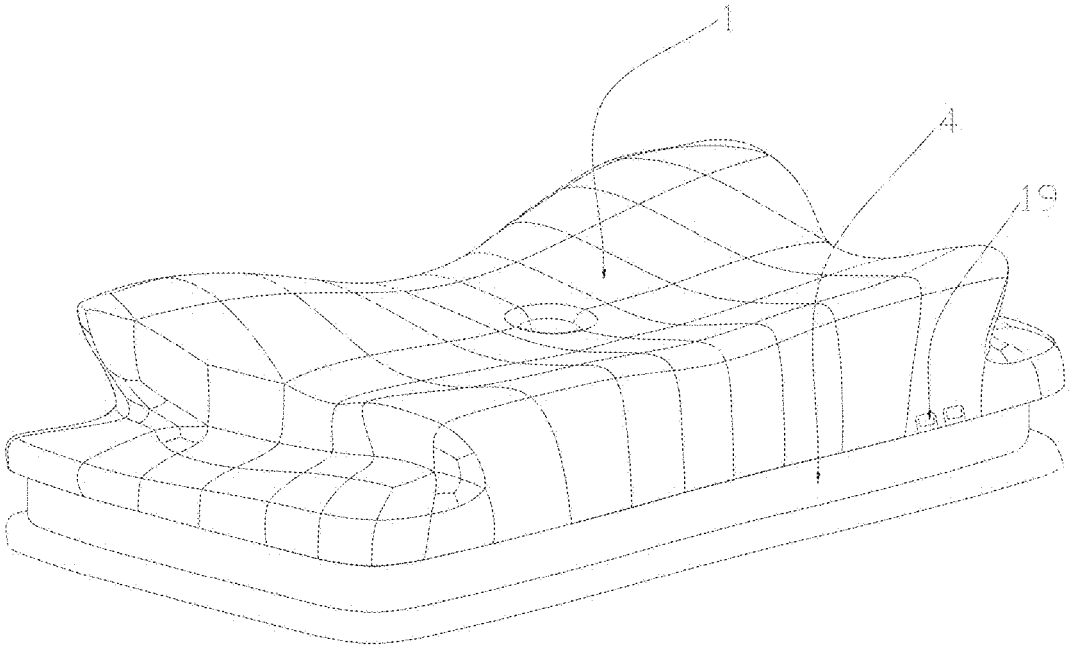
FIG. 6 is a schematic diagram of another overall structure of the pillowcase according to Embodiment 1 of the present disclosure.
Figure 7:
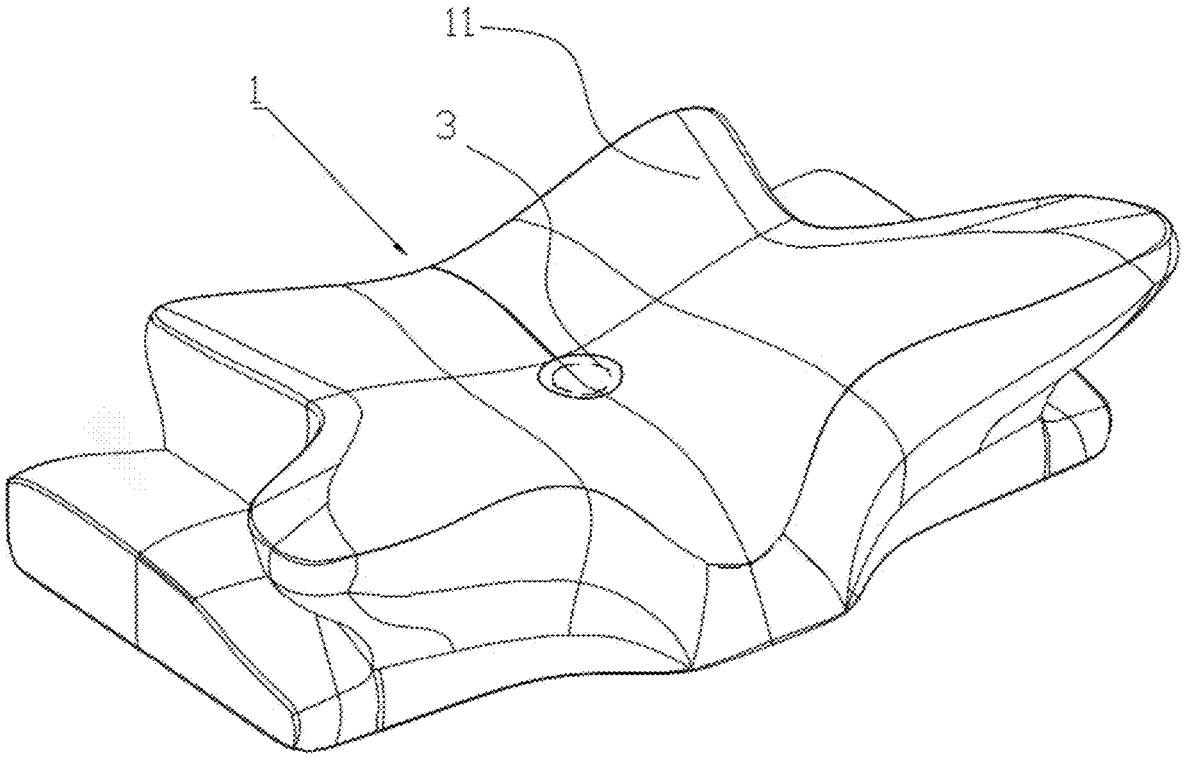
FIG. 7 is a schematic diagram of an entire structure of a pillowcase according to Embodiment 2 of the present disclosure.
Figure 8:
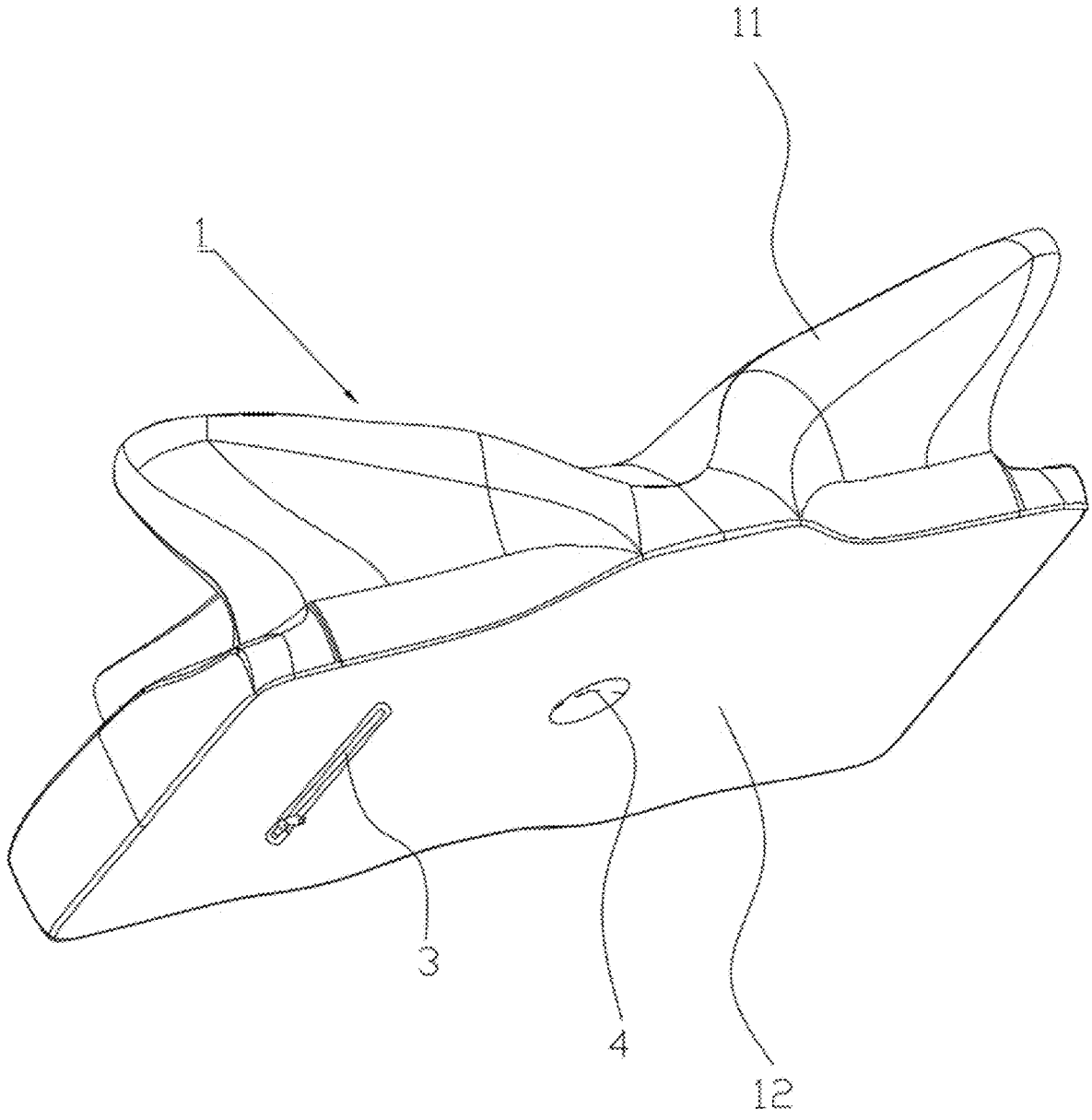
FIG. 8 is a schematic diagram of another overall structure of the pillowcase according to Embodiment 2 of the present disclosure.
Figure 9:
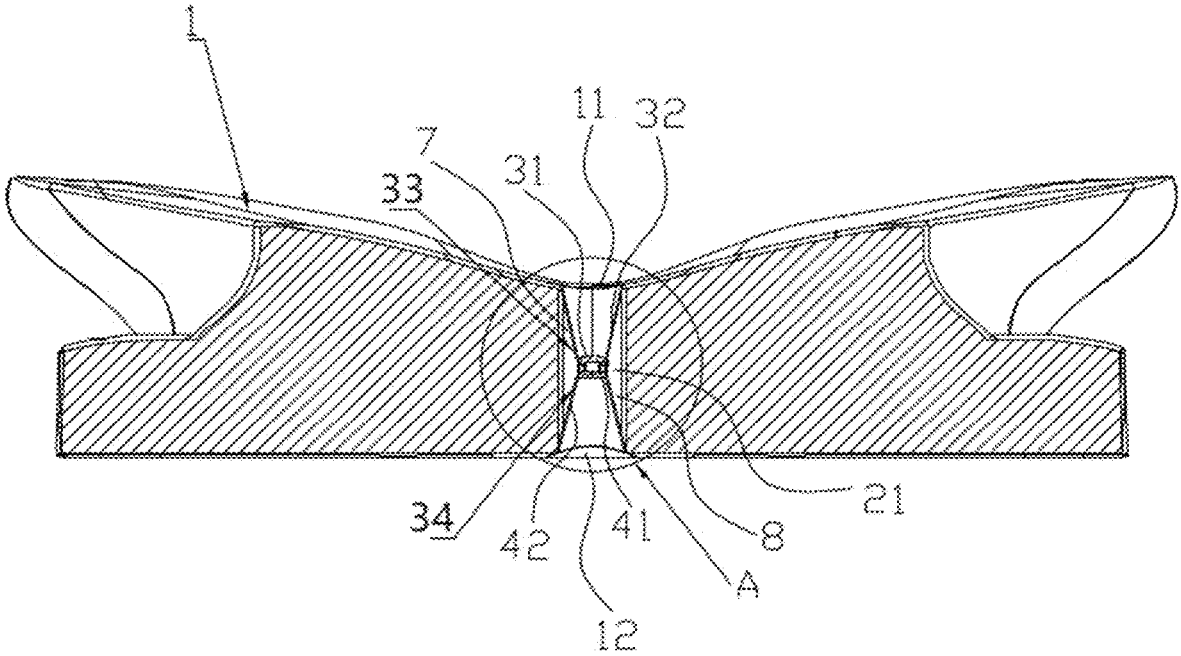
FIG. 9 is cross-sectional view of a side surface of a pillow according to Embodiment 2 of the present disclosure.
Figure 10:
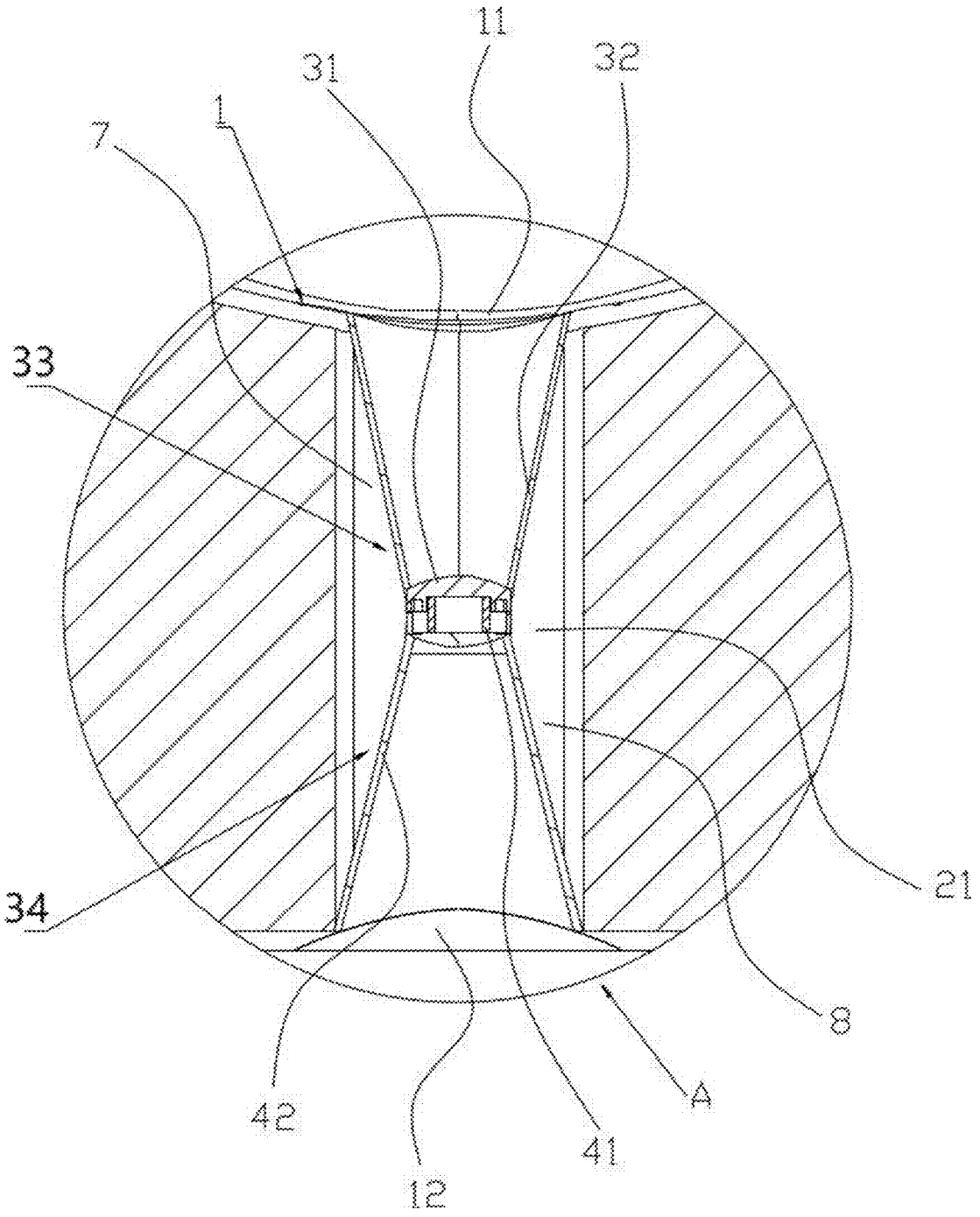
FIG. 10 is an enlarged view of portion A in FIG. 9.

As shown in FIG. 6, in another embodiment, the upper covering surface 11 and the lower covering surface 12 are detachably connected (for example, by at least one fastener 19 or another detachable hook and loop fastener or a zipper), so that at least one edge of a joint between the upper covering surface 11 and the lower covering surface 12 is completely detached or connected, so as to sleeve the pillowcase main body 1 on the pillow core 4 or separate the pillowcase main body 1 from the pillow core 4.

Embodiment 2 and Embodiment 3

In the embodiments shown in FIGS. 7-10 and FIGS. 10-13, the material used for the pillowcase 1 is the same as that in the aforementioned embodiments. The difference lies in that: the pillowcase 1 at least includes an accommodating opening 3 The pillowcase 1 has a first through hole 21 extending from the upper covering surface 11 to the lower covering surface 12. The Pillowcase 1 further includes: an outer cover portion 35 connected between the upper covering surface 11 and the lower covering surface 12, enclosing a periphery of the pillow core; and a connecting member 10 connected between the upper covering surface 11 and lower covering surface 12 and passing through first through hole 21.

The connecting member 10 has an annular cross-section and is circumferentially disposed around a wall surface of first through hole 21. The connecting member 10 further forms a second through hole 22 running from the upper side to the lower side of the pillow.

Specifically:

The first through hole 21 has an inner diameter ranging from 1 cm to 20 cm. The second through hole 22 has an inner diameter ranging from 1 cm to 20 cm. The first through hole 21 has a depth ranging from 3 cm to 15 cm. The second through hole 22 has a depth ranging from 3 cm to 15 cm.

Each of the first through hole 21 and the second through hole 22 may be one of: a circular hole, an elliptical hole, a square hole, a rectangular hole, a diamond-shaped hole, a hexagonal hole, a triangular hole, and a cross-shaped hole.

It is to be understood that: the first through hole 21 has a maximum inner diameter and a minimum inner diameter each independently ranging from 1 cm to 20 cm; the second through hole 22 includes a maximum inner diameter and a minimum inner diameter each independently ranging from 1 cm to 20 cm. This dimensional range ensures optimal ventilation while maintaining sufficient structural support. The depth of the first through hole and the second through hole ranges from 3 cm to 15 cm, which can achieve a favorable ventilation effect while ensuring the required support height.

Additionally, the first through hole 21 and the second through hole 22 can be in various shapes, which can be customized according to actual needs to enhance user experience.

Figure 11:
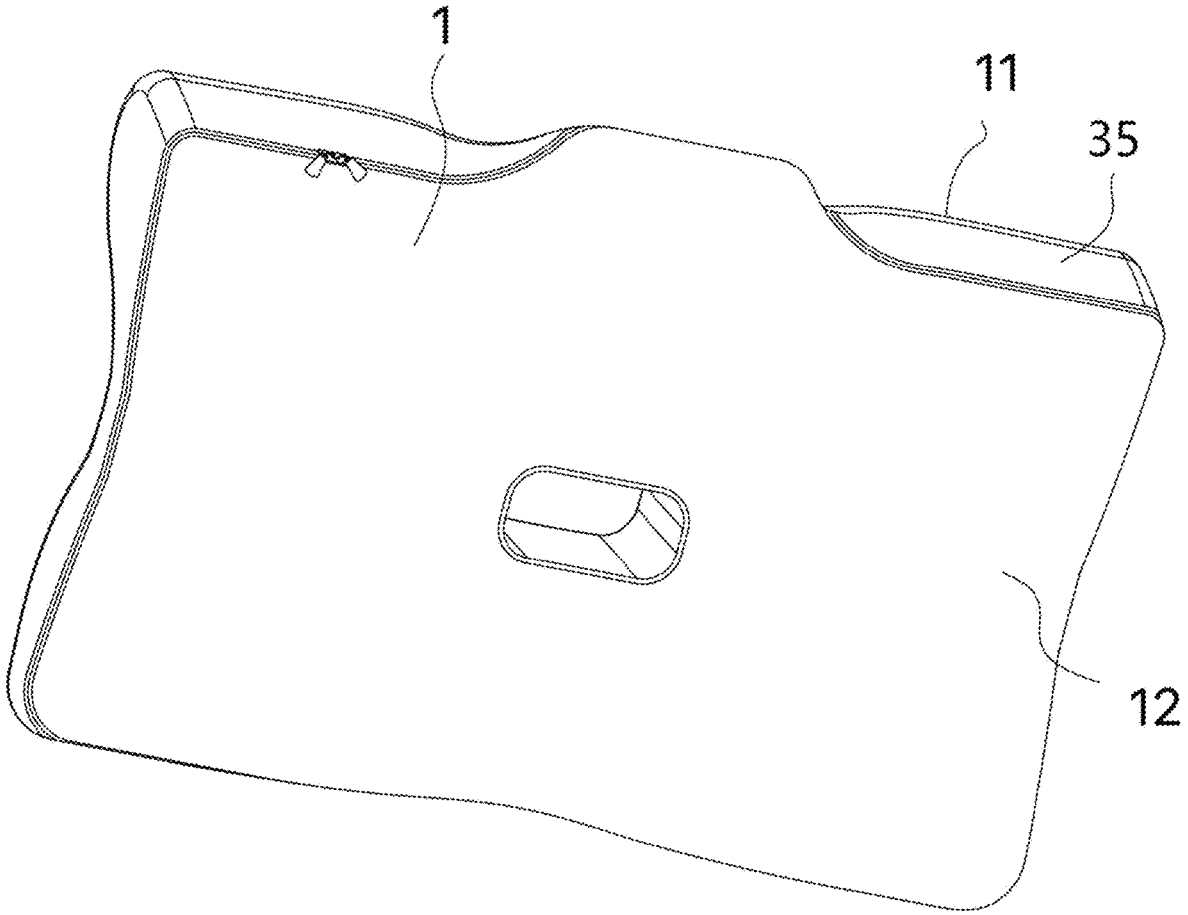
FIG. 11 is a schematic diagram of an entire structure of a pillowcase according to Embodiment 3 of the present disclosure.
Figure 12:
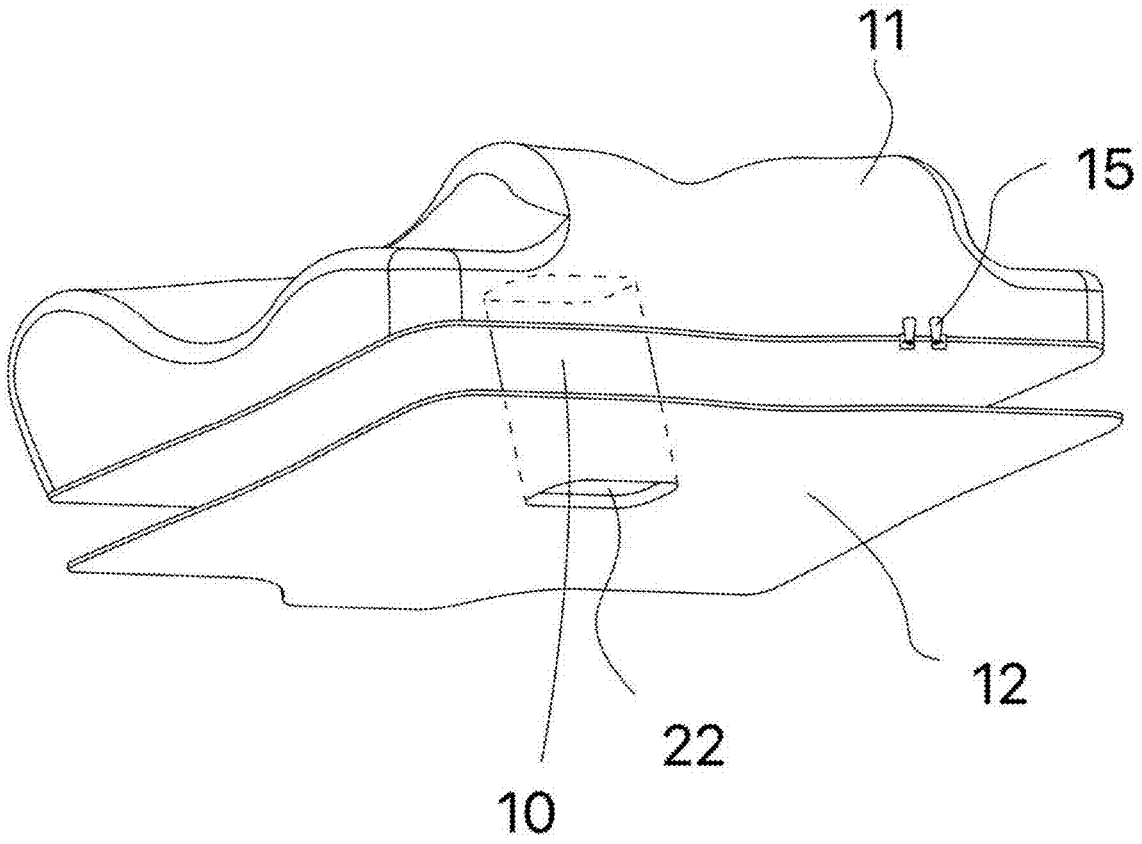
FIG. 12 is an exploded view of the pillowcase according to Embodiment 3 of the present disclosure.
Figure 13:
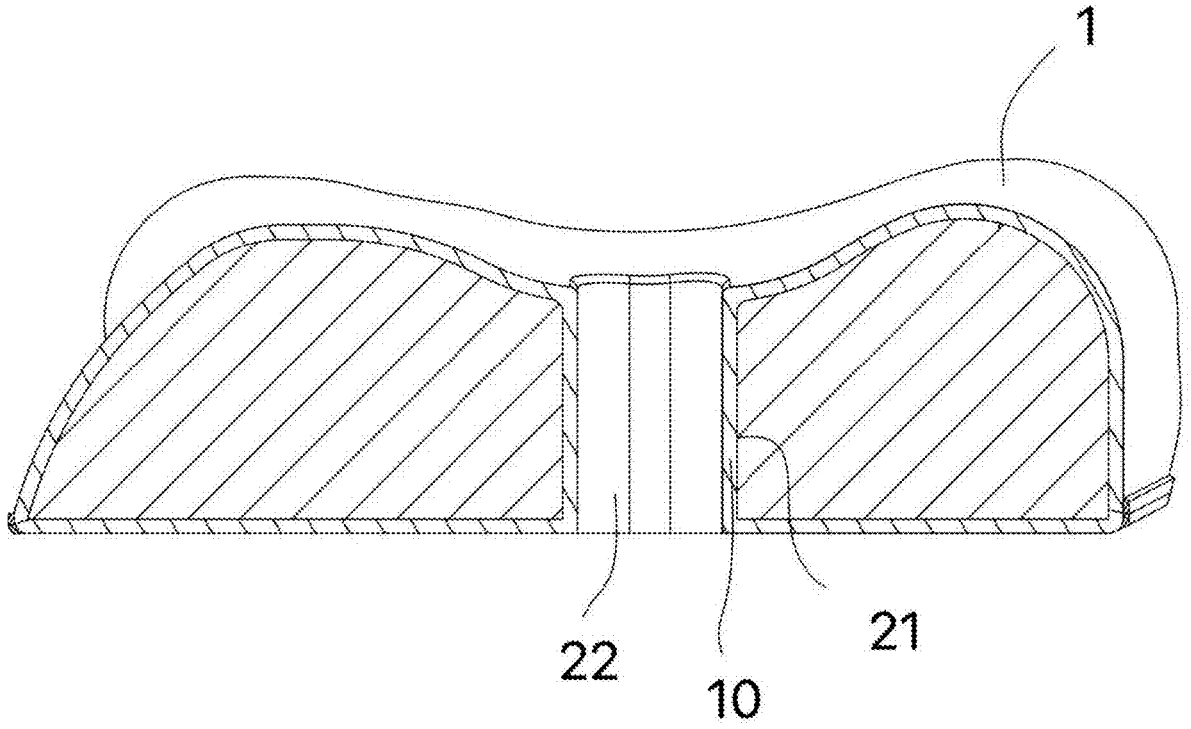
FIG. 13 is cross-sectional view of the pillowcase according to Embodiment 3 of the present disclosure.

At least one of the upper covering surface 11 and the lower covering surface 12 is detachably connected to the outer cover portion 35 to form a first angle (e.g., via at least one zipper 36 as shown in FIGS. 11-13, or other detachable fasteners such as hook-and-loop straps, buttons as illustrated in FIGS. 7-10, etc.), enabling complete detachment or attachment of an edge of either the upper covering surface 11 or the lower covering surface 12 from/to an edge of the outer cover portion 35.

Specifically, one of the upper covering surface 11 and the lower covering surface 12 is detachably connected to the outer cover portion 35; while the other of the upper covering surface 11 and the lower covering surface 12 is fixedly connected to outer cover portion 35 to form a second angle. This configuration prevents edges of the detachable connection from interfering with a user's head or neck region, thereby ensuring optimal user comfort.

Each of the first angle and the second angle may be, but not limited to a right angle.

The connecting member 10 includes a first connecting member 33 disposed on the upper covering surface 11 and a second connecting member 34 disposed on the lower covering surface 12. The first connecting member 33 is detachably connected to the second connecting member 34 through the first through hole 21, thereby enabling the upper covering surface 11 and the lower covering surface 12 to clamp the pillow core within pillowcase 1.

The first connecting member 33 is disposed on an inner side of the upper covering surface 11, and the second connecting member 34 is disposed on an inner side of the lower covering surface 12. The first connecting member 33 includes a first connection portion 31 and a first connection surface 32. A side of the first connection surface 32 is connected to an inner side of the upper covering surface 11, another side of the first connection surface 32 is connected to the first connection portion 31.

The second connecting member 34 includes a second connection portion 41 and a second connection surface 42. One side of the second connection surface 42 is connected to an inner side of the lower covering surface 12, and another side of the second connection surface 42 is connected to the second connection portion 41. Specifically, the first connection portion 31 is a first connection buckle, the second connection portion 41 is a second connection buckle, and the first connection buckle is detachably connected to the second connection buckle. Through such configurations, the upper covering surface 11 and the first connection surface 32 covers the first connection buckle, the lower covering surface 12 and the second connection surface 42 covers the second connection buckle, so as to hide the first connection buckle and the second connection buckle, which not only makes the pillowcase 1 smoother and more aesthetically pleasing when fitted onto the pillow core, but also effectively prevents users from coming into direct contact with the first connecting buckle and the second connecting buckle during use. This helps to avoid feeling of foreign objects or discomfort in the user's cervical spine, making the pillow more acceptable to users. Furthermore, the first connecting surface 32 is attached to the inner side of the upper covering surface 11 by stitching, and the second connection surface 42 is attached to the inner side of the lower covering surface 12 by stitching.

When the first connecting member 33 is connected to the second connecting member 34 through the first through hole 21, causing the upper covering surface 11 and the lower covering surface 12 to clamp the pillow core within the pillowcase 1, a first gap 7 exists between the upper covering surface 11 and the first through hole 21, and a second gap 8 exists between the lower covering surface 12 and the first through hole 21. The first gap 7, the first through hole 21, and the second gap 8 are interconnected to form a heat dissipation channel. Through this configuration, when a user uses the pillow, heat can be dissipated through the heat dissipation channel, preventing heat from accumulating on the pillow. This allows the user to have a more comfortable sleeping environment, thereby improving the user's sleep quality.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A pillowcase, comprising:

a pillowcase main body, wherein the pillowcase main body is made of a fabric; the pillowcase main body comprises an upper covering surface and a lower covering surface; the upper covering surface is connected to the lower covering surface to form a first accommodating space configured to accommodate a pillow core; the fabric comprises a carrier and a care agent; the care agent is mixed with the carrier through an immersion method; a liquid pick-up rate is controlled between 60% and 80%; and shaping and drying are carried out to mix the care agent with the carrier;

wherein the pillowcase main body further comprises a connecting member configured to pass through a first through channel penetrating from an upper side of the pillow core to a lower side of the pillow core and connect between the upper covering surface and the lower covering surface;

wherein the connecting member comprises a first connecting member disposed on the upper covering surface and a second connecting member disposed on the lower covering surface; the first connecting member is detachably connected to the second connecting member, and the first connecting member and the second connecting member are arranged at the central axis of the first through channel in the first through channel.

2. The pillowcase according to claim 1, wherein the carrier is formed by interweaving polyamide fiber with the spandex.

3. The pillowcase according to claim 1, wherein a material of the carrier comprises spandex and a polyamide fiber, the polyamide fiber in the carrier accounts for 60% to 95%, and the spandex accounts for 5% to 40%.

4. The pillowcase according to claim 1, wherein the care agent is added to the carrier according to a ratio of 20 g/L to 50 g/L.

5. The pillowcase according to claim 1, wherein the pillowcase includes a front side, a rear side, a left side, a right side, an upper side, and a lower side, wherein the left side is opposite to the right side, the front side is opposite to the back side, and the upper side is opposite to the lower side.

6. The pillowcase according to claim 5, wherein a distance from the left side to the right side is a first distance, and the first distance is 30 cm to 145 cm.

7. The pillowcase according to claim 6, wherein the first distance is 40 cm to 60 cm.

8. The pillowcase according to claim 5, wherein a distance from the front side to the back side is a second distance, and the second distance is 15 cm to 60 cm.

9. The pillowcase according to claim 8, wherein the second distance is 20 cm to 40 cm.

10. The pillowcase according to claim 5, wherein a distance from the upper side to the lower side is a third distance; and the third distance is 0 to 16 cm.

11. The pillowcase according to claim 10, wherein the third distance is 10 cm to 15 cm.

12. The pillowcase according to claim 1, wherein the pillowcase main body at least comprises an accommodating opening; and a pillow core is placed in the first accommodating space through the accommodating opening.

13. The pillowcase according to claim 1, wherein the care agent at least comprises sodium hyaluronate.

14. The pillowcase according to claim 1, wherein the care agent further comprises at least one of a moisturizer, an antioxidant, and a fragrance.

15. The pillowcase according to claim 1, wherein the pillowcase main body further comprises:

an outer cover portion connected between the upper covering surface and the lower covering surface and enclosing a periphery of the pillow core.

16. The pillowcase according to claim 15, wherein one of the upper covering surface and the lower covering surface is detachably connected to the outer cover portion, and another of the upper covering surface and the lower covering surface is fixedly connected to the outer cover portion.

17. The pillowcase according to claim 16, wherein a lower edge of the outer cover portion is detachably connected to a lower edge of the lower covering surface, forming a first angle; and an upper edge of the outer cover portion is fixedly connected to an upper edge of the upper covering surface, forming a second angle.

* * * * *